United States Patent [19]

Yuhara et al.

[11] Patent Number: 4,951,692

[45] Date of Patent: Aug. 28, 1990

[54] VANITY CASE

[75] Inventors: Yukitomo Yuhara, Abiko; Sumio Okojima, Yachimata, both of Japan

[73] Assignee: Yoshida Indsutry Co., Ltd., Tokyo, Japan

[21] Appl. No.: 268,969

[22] Filed: Nov. 9, 1988

[30] Foreign Application Priority Data

| | | | |
|---|---|---|---|
| Dec. 14, 1987 | [JP] | Japan | 62-188871[U] |
| Dec. 14, 1987 | [JP] | Japan | 62-188872[U] |
| Mar. 22, 1988 | [JP] | Japan | 63-36384[U] |
| Apr. 11, 1988 | [JP] | Japan | 63-47811[U] |
| Apr. 11, 1988 | [JP] | Japan | 63-47814[U] |

[51] Int. Cl.[5] ..... A45D 33/00

[52] U.S. Cl. ..... 132/293; 132/294; 132/301; 206/823

[58] Field of Search ..... 132/293, 294, 301, 314, 132/315, 316; 206/581, 823

[56] References Cited

U.S. PATENT DOCUMENTS

| | | | |
|---|---|---|---|
| 4,276,893 | 7/1981 | Enomoto et al. | 132/301 |
| 4,331,168 | 5/1982 | Hatakeyama | 132/316 |
| 4,366,829 | 1/1983 | Yuhara | 132/301 |
| 4,399,826 | 8/1983 | Ogasawara | 132/301 |
| 4,474,196 | 10/1984 | Yuhara | 132/301 |
| 4,483,355 | 11/1984 | Yuhara | 132/301 |
| 4,595,028 | 6/1986 | Yuhara | 132/314 |
| 4,679,576 | 7/1987 | Yuhara | 132/293 |
| 4,683,899 | 8/1987 | Yuhara | 132/293 |
| 4,696,317 | 9/1987 | Shioi et al. | 132/314 |
| 4,799,503 | 1/1989 | Tahara | 206/823 |

FOREIGN PATENT DOCUMENTS

| | | | |
|---|---|---|---|
| 2471326 | 6/1981 | France | 132/315 |
| 2566373 | 12/1985 | France | 206/823 |
| 61-18167 | 6/1985 | Japan . | |
| 61-12005 | 4/1986 | Japan . | |
| 61-143502 | 9/1986 | Japan . | |
| 2202513 | 9/1988 | United Kingdom | 206/823 |

*Primary Examiner*—John J. Wilson
*Assistant Examiner*—Frank A. LaViola, Jr.
*Attorney, Agent, or Firm*—Wenderoth, Lind & Ponack

[57] ABSTRACT

A vanity case includes a receptacle, a cover hinged to the receptacle at the rear end thereof, a first latch tongue formed on the receptacle, and a second latch tongue formed on the cover to engage with the first latch tongue for maintaining the cover in a closed position with respect to the receptacle. A release member is disposed between the periphery of the receptacle and the periphery of the cover and includes an inner part and an outer part which is positioned at a level higher than the inner part and connected therewith by a step. The inner part is adjacent the lower surface of the cover while the outer part is spaced from the upper surface of the receptacle when the cover is in the closed position. A hole is formed in one of the release member and the receptacle, and leg is formed on the other and is fitted in the hole to thereby attach the release member to the upper surface of the receptacle in such a manner that the release member is swingable relative to the receptacle.

15 Claims, 9 Drawing Sheets

VANITY CASE

BACKGROUND OF THE INVENTION

1. Field of the Invention

The present invention relates to a vanity case of the type in which a receptacle member and a cover member are hinged together at respective rear ends there of, and the cover member is maintained in a closed position with respect to the receptacle member by engagement of a first latch means formed on the receptacle member with a second latch means formed on the cover member, and more specifically to an improved releasing mechanism for such engaging means.

2. Description of the Prior Art

When a vanity case of this type has a latch means whose engagement is weak, it is likely that the cover member may open accidentally, or that cosmetic material in the receptacle may be contaminated by dust because of inadequate sealing. Therefore it is necessary to form the latch means of such dimensions and configuration that they will engage each other tightly. However, the tighter the engagement between the latch means, the greater the force required for and thus the more difficulty in releasing the engagement. Therefore, in order to release the engagement by a slight force, various types of releasing mechanisms have been proposed.

One example of such vanity case is disclosed in Japanese Utility Model Publication No. 60-18167. In this vanity case, a recess is formed at a front marginal portion of a receptacle member, and in each side wall defining the recess is provided a hole into which is inserted a boss projecting from each side of a finger piece so that the finger piece may be pivotted within the recess. A thrust part formed at the inner end of the finger piece is adapted to abut the underside of the cover member so that, when the finger piece is rotated, the thrust part can exert an upward force to the cover member to thereby release the engagement. Another example of vanity case having a releasing mechanism is disclosed in Japanese Utility Model Publication No. 61-12005 in which a support is provided inside a receptacle member. At each side of the support is formed a groove into which is fitted a boss projecting from each side of an operation member whereby the latter is pivotally secured to the support. When the outer part of the operation member is pushed, its inner part thrusts up the cover member.

However, in the former vanity case (No. 60-18167) the rotation or swing motion of the finger piece is performed mainly within the recess in the receptacle member. Therefore, in order to increase the swing stroke of the piece for an improved releasing operation, the dimensions of the recess must be enlarged to result in the vanity case itself becoming bulky. Further, both of the above vanity cases include the boss and the holes or grooves for receiving the boss, which requires a mold die of complicated structure and thus involves high manufacturing cost. Additionally, dimensional irregularity tends to occur in forming the small-diametered parts such as bosses and holes, resulting in a high rate of defective products. There is also a known vanity case which may solve these problems by using a separately formed pin for securing a finger piece. However, this structure exposes the ends of the pin to visual access with resultant degraded external appearance. Further, the increased number of the parts takes up a great deal of time in manufacture and assembly.

Accordingly, an object of the present invention is to provide a vanity case whose engaging latch means can be released by a very easy operation.

Another object of the invention is to provide a vanity case which can be efficiently manufactured without the need of any complicated mold dies, and which can be easily assembled.

SUMMARY OF THE INVENTION

According to the invention, a vanity case includes a receptacle member, a cover member hinged to the receptacle member at the rear end thereof, a first latch tongue formed on the receptacle member and a second latch tongue formed on the cover member to engage with the first latch tongue for maintaining the cover member in a closed position with respect to the receptacle member. A release member is disposed between the periphery of the receptacle member and the periphery of the cover member, and includes an inner part and an outer part which is positioned at a level higher than the inner part and connected therewith by a step. The inner part is adjacent the lower surface of the cover member while the outer part is spaced from the upper surface of the receptacle member when the cover member is in the closed position. A hole is formed in one of the release member and the receptacle member and, a leg is formed on the other member and is fitted in the hole to thereby attach the release member to the upper surface of the receptacle member in such a manner that the release member is swingable relative to the receptacle member.

In the thus constituted vanity case, when the outer part of the release member is pressed down toward the upper surface of the receptacle member, the inner part of the release member can thrust up the cover member as a result of a lever action, i.e. leverage, to thereby release the engagement of the latch tongues for opening the cover member.

In one embodiment of the invention, the leg is loosely fitted in the hole for permitting the release member to swing relative to the receptacle member. In another embodiment of the invention, a thin flexible hinge portion is formed at the base end of the leg so as to permit the release member to swing relative to the receptacle member. Both these structures can be combined together to further increase the swing stroke.

Other objects, features and advantages of the invention will be apparent from the following detailed description when taken in conjunction with the accompanying drawings.

DETAILED DESCRIPTION OF THE INVENTION

Figure 1:
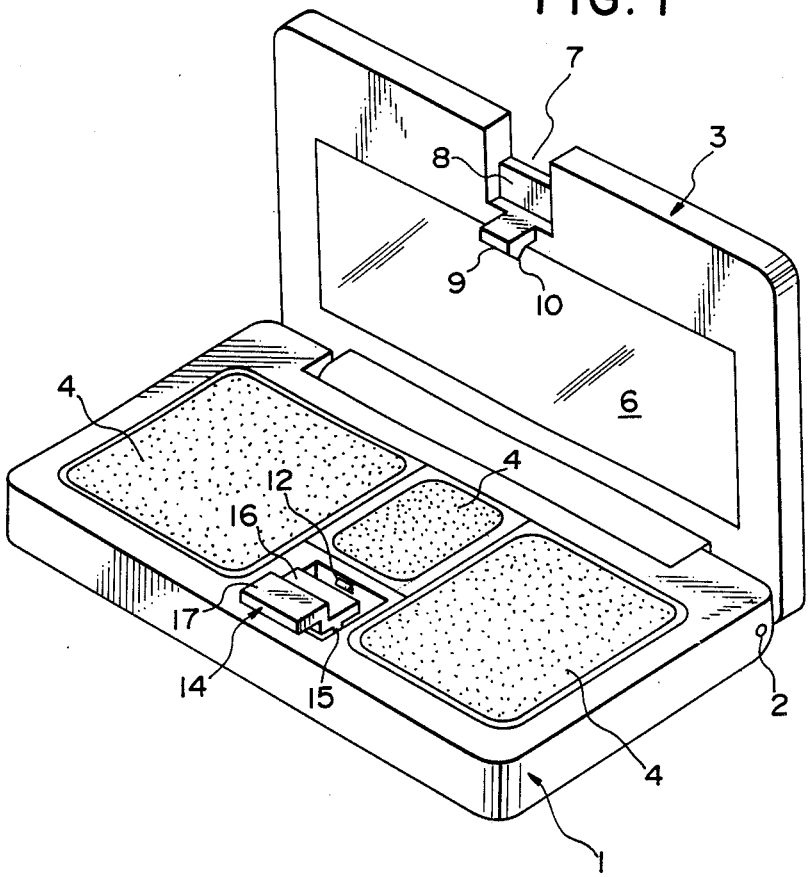
FIG. 1 is a perspective view of a vanity case according to a first embodiment of the invention.

Referring to FIGS. 1 to 4 of the drawings showing a vanity case according to a first embodiment of the present invention, the vanity case includes a receptacle member 1 of plastic material, and a cover member 3 also of plastic material which is hinged by a pin 2 to the rear end of the receptacle 1. Trays 5 filled with plural kinds of cosmetic material 4 are accommodated in the receptacle 1, and a mirror 6 is attached to the lower surface of the cover 3. A cutout 7 is provided at the center of the front marginal portion of the cover 3, and a recess 8 is formed in the lower surface of the cover 3 at a position inside the cutout 7 and continuous therewith. A lug 9 extends downwardly from the lower surface adjacent the recess 8, and at the lower end of the lug 9 is formed a second latch tongue 10 projecting inwardly. An indentation 11 is provided in the upper surface of the receptacle 1 at a position corresponding to the lug 9, and a first latch tongue 12 extends forwardly from the rear wall defining the indentation 11 and engages elastically with the second latch tongue 10 on the lug 9 so that the cover 3 may be closed over the receptacle 1.

Provided in front of the indentation 11 is a hole 13 extending through the receptacle 1, and in this hole 13 is fitted a leg 15 of a release member 14. The release member 14 is generally in the form of a plate having a step and comprises an inner part 16 and an outer part 17 which is positioned at a level higher than the inner part and is integrally connected therewith through a step 18. The leg 15 extends vertically downward from the underside of the inner part 16 adjacent the step 18. The hole 13 has larger dimensions than the leg 15 so as to permit the leg 15 to swing therein. Thus, the leg 15 is loosely fitted in the hole 13. At the rear surface of entrance of the hole 13 is provided a projection 19 while an enlarged head 20 in the form of a hook is provided at the lower end of the leg 15 so that the projection 19 and the enlarged head 20 cooperate together to prevent removal of the leg 15 from the hole 13. A portion of the wall defining the hole 13 opposite the projection 19 is cut away to form a slant or inclined surface 21 which serves to increase the swing stroke of the leg 15. The dimensions of various components are determined such that the inner part 16 and the outer part 17 of the release member 14 are located respectively in the recess 8 and in the cutout 7 with the upper and the front surfaces of the outer part 17 being flush respectively with the upper surface and the front end wall of the cover 3 and with the underside of the inner part 16 being at the same level as the underside of the cover 3, when the cover member 3 is in the closed position. In order to enhance visual appeal of the vanity case, if desired, the color of the release member 14 can be different from that of the receptacle 1 and the cover 3.

To secure the release member 14 to the receptacle 1, the leg 15 is simply forced into the hole 13 so that, once the hook-like head 20 has passed through the projection 19 by elastic deformation, the leg 15 is held in the hole 13. When the cover 3 is closed, the inner part 16 of the release member 14 takes the position in the recess 8 and adjacent the lower surface of the cover 3, while the outer part 17 is located above and spaced from the upper surface of the receptacle 1. A corner 22 at the lower end of the step 18 is positioned adjacent the upper surface of the receptacle 1 in front of the hole 13. The periphery of the lower surface of the cover 3 abuts the periphery of the upper surface of the receptacle 1 except at the recess 8 and the lug 9.

Figure 2:
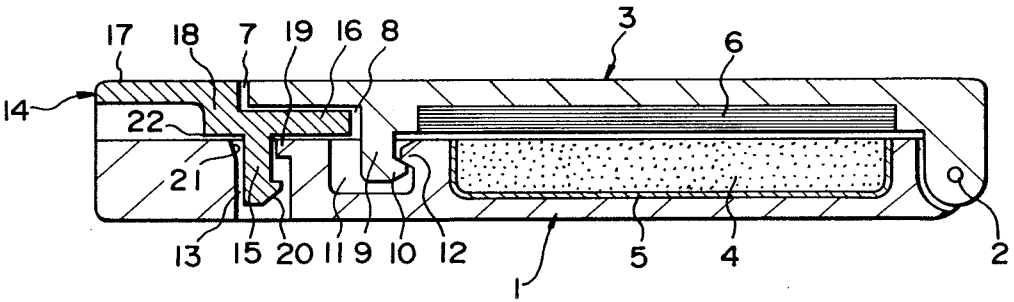
FIG. 2 is a longitudinally sectioned view of the vanity case of FIG. 1 showing a cover member in a closed position.
Figure 3:
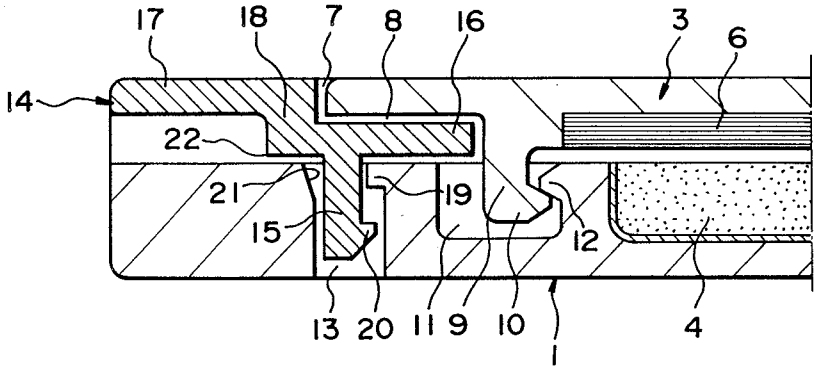
FIG. 3 is an enlarged fragmentary sectional view thereof.
Figure 4:
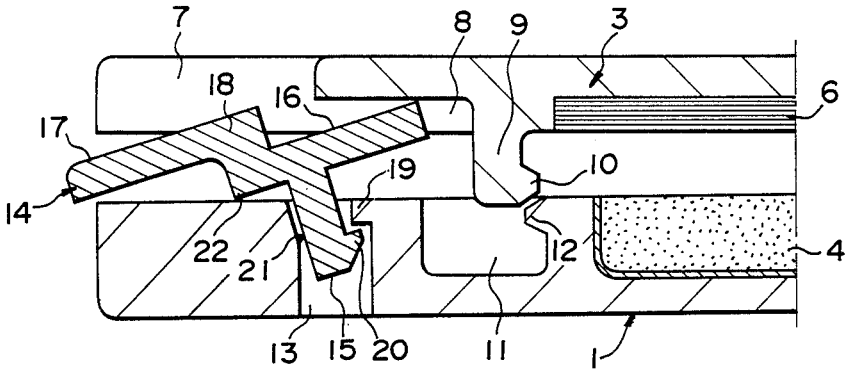
FIG. 4 is a view similar to FIG. 3 showing a releasing operation.

Assuming that the cover 3 is in the closed position shown in FIGS. 2 and 3 and when the outer part 17 of the release member 14 is pressed down toward the upper surface of the receptacle 1 by a finger of the user, the leg 15 swings or pivots in the hole 13 whereby the release member 14 acts as a lever about a fulcrum formed by the corner 22, thus causing the inner part 16 to thrust up the cover 3. This upward thrust disengages the second latch tongue 10 from the first latch tongue 12, thereby releasing the cover 3 (See FIG. 4). Thereafter, the cover 3 can be opened to a desired angle by a finger of the user holding the front end of the cover 3 so that the cosmetic material 4 and the mirror 6 can be used conveniently. When, after use, the cover 3 is closed over the receptacle 1, the second latch tongue 10 simply engages the first latch tongue 12 due to their elasticity, and thus the release member 14 returns to the position as shown in FIG. 3.

Figure 5:
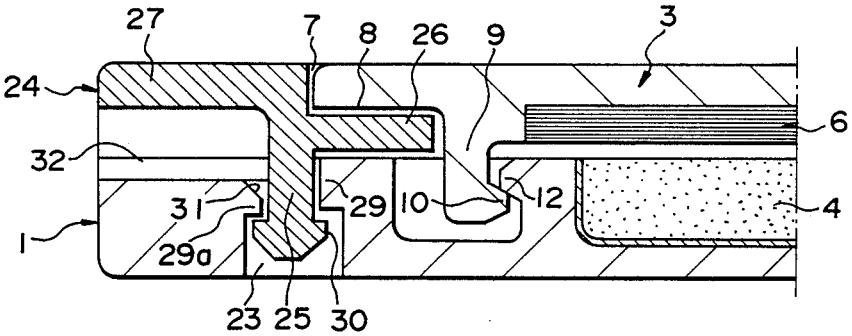
FIGS. 5 and 6 are fragmentary sectional views of a vanity case according to a second embodiment of the invention.
Figure 6:
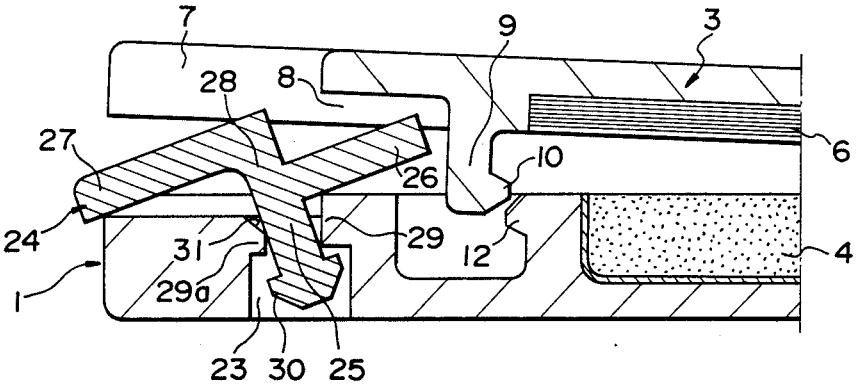

FIG. 5 shows a vanity case according to a second embodiment of the present invention, of which description will be made only about components different from those of the first embodiment. A step 28 of release member 24, at which an inner part 26 and an outer part 27 are joined together, is aligned with a leg 25 with the outer wall of the step 28 being linearly continuous with the outer wall of the leg 25. A hole 23 is provided in the receptacle 1 at a position corresponding to the boundary between the cutout 7 and the recess 8 in the cover 3, and at the entrance of the hole 23 are provided projections 29 and 29a which respectively extend from the rear wall and the front wall of the hole. The upper end of the projection 29a has a slant or inclined surface 31. The leg 25 is held in the hole 23 by means of these projections 29 and 29a cooperating with an enlarged head 30 formed at the lower end of the leg 25. Formed on the upper surface of the receptacle 1 is a groove 32 which extends in front of the hole 23 and which has the same width as the release member 24. When the outer part 27 of the release member 24 is pressed down, the hole 23 allows the leg 25 to swing or pivot therein so that the release member 24 acts like a lever, causing the inner part 26 to thrust up the cover 3 (See FIG. 6). During this operation, the underside of the inner part 26 adjacent the leg 25 abuts against the upper corner of the projection 29 to act as a fulcrum. The groove 32 is advantageous because it increases the swing stroke of the outer part 27 of the release member 24 to thereby increase the initial opening angle of the cover 3.

Figure 7:
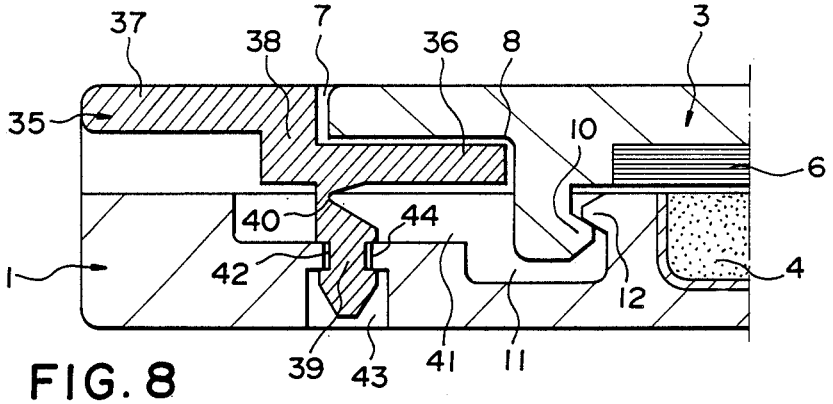
FIGS. 7 and 8 are fragmentary sectional views of a vanity case according to a third embodiment of the invention.

FIG. 7 shows a vanity case according to a third embodiment of the present invention. In this embodiment, a leg 39 extends downwardly adjacent a step 38 which connects an inner part 36 and an outer part 37 of a release member 35 together, and the inner wall of the upper end of leg 39 is cut away in a V-shaped notch to form a thin flexible hinge portion 40. On the upper surface of the receptacle 1 is formed a depression 41 which is situated in front of the indentation 11 and shallower than the latter, and in which the upper part of the leg 39 including the hinge portion 40 is disposed. A groove 42 is formed in each of the front and rear walls of the lower part of the leg 39 the lower end of which has an arrow-shaped cross section. A hole 43 extends downwardly from the bottom of the indentation 41, and the entrance of the hole 43 is provided with flanges 44 which fit into the grooves 42 to hold the leg 39 fixedly in the hole 43. In assembly the end of the leg 39 can be forced into the hole 43 due to elastic deformation.

Figure 8:
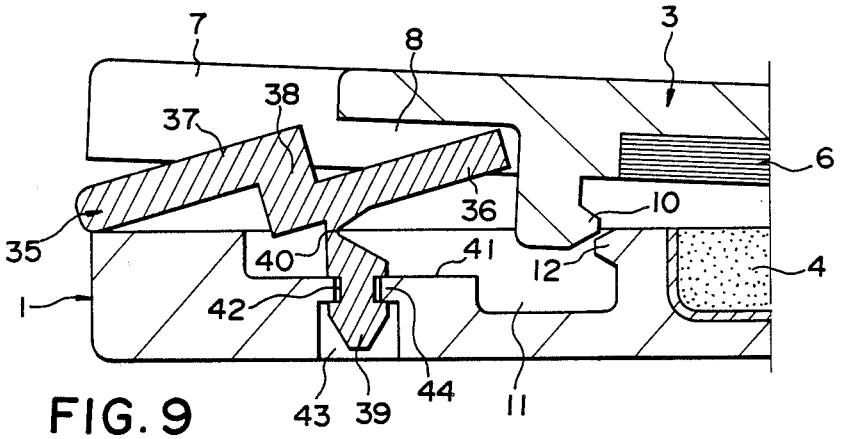

To release the cover 3 from the position of FIG. 7, the outer part 37 of the release member 35 simply has to be pressed down whereby the outer part 37 together with the inner part 36 swings at the hinge portion 40 relative to the leg 39. As a result the inner part 36 thrusts up the cover 3, causing the second latch tongue 10 to disengage from the first latch tongue 12 (See FIG. 8). During this operation the hinge portion 40 acts as a fulcrum of a lever so that the cover 3 can be released by a slight force, as in the above embodiments. Shape of the hinge portion 40 is not specifically limited to the illustrated structure. For example, both the front and rear walls of the leg 39 may be notched to leave the central part which is to be tightly fitted in the hole 43.

Figure 9:
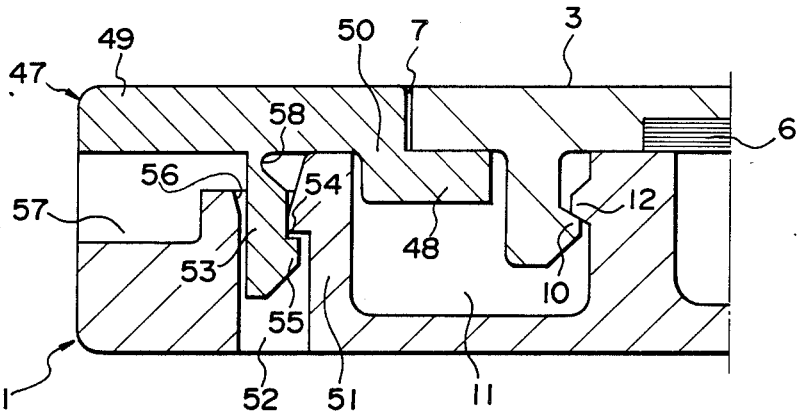
FIGS. 9 and 10 are fragmentary sectional views of a vanity case according to a fourth embodiment of the invention.
Figure 10:
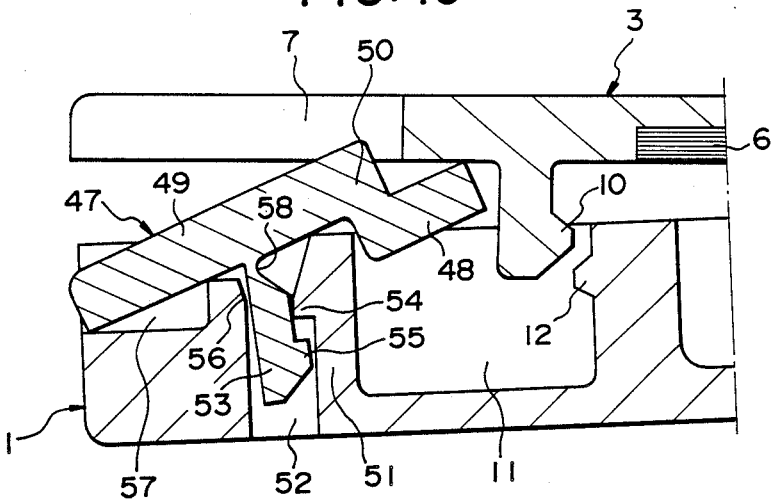

FIGS. 9 and 10 show a vanity case according to a fourth embodiment of the present invention which incorporates a combination of the loose fitting leg of the first embodiment and the hinge portion of the third embodiment. More precisely, a release member 47 includes an outer part 49 having about the same thickness as the cover 3 and received in the cutout 7, and an inner part 48 joined by a step 50 to the inner end of the outer part 49 with the upper surface thereof abutting the lower surface of the cover 3. The outer part 49 of the release member 47 rests on an upper end surface of a vertical wall 51 defining the indentation 11, and in front of the vertical wall 51 is provided a hole 52 in which a leg 53 extending from the underside of the outer part 49 is loosely fitted. Formed at the upper end of the vertical wall 51 is a projection 54 extending into the hole 52, and this projection cooperates with a hook-like head 55 formed at the lower end of the leg 53 to prevent removal of the leg 53 from the hole 52. The opposite wall defining the hole 52 is formed shorter than the vertical wall 51, and the upper part of that wall has a slant or inclined surface 56 adapted to permit the leg 53 to swing in the hole 52. A groove 57 of about the same width as the release member 47 is provided at the front marginal portion of the receptacle 1. Provided at the upper end of the leg 53 is a thin flexible hinge portion 58 at which the inner and the outer parts 48 and 49 can swing relative to the leg 53.

When the outer part 49 of the release member 47 is pressed down, first the entire release member 47 swings relative to the receptacle 1 with the leg 53 swinging in the hole 52, and then the outer part 49 and the inner part 48 swing at the hinge portion 58 relative to the leg 53. Consequently, the cover 3 can be opened to a larger angle due to the combined swing motions (See FIG. 10).

Figure 11:
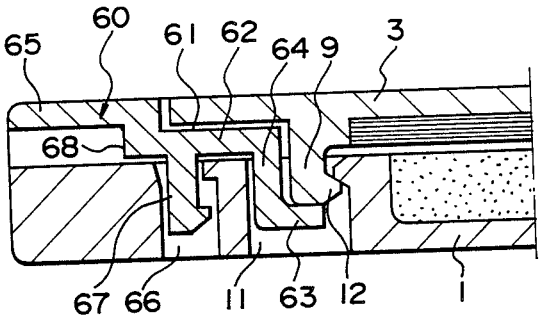
FIGS. 11 and 12 are fragmentary sectional views of a vanity case according to a fifth embodiment of the invention.
Figure 12:
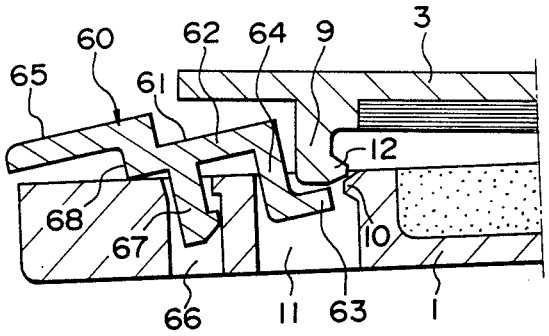

In all the above embodiments the inner part of the release member thrusts up the lower surface of the cover 3 in front of the lug 9, but it may also act on any other portion of the cover 3, for example, the lower end of the lug 9. One such construction is incorporated in a vanity case according to a fifth embodiment of the present invention as shown in FIGS. 11 and 12 in which an inner part 61 of a release member 60 comprises an upper level 62 and a lower level 63, and thus the release member has two steps. The lower level 63 extends inwardly from the lower end of a second step 64 which in turn extends downwardly from the inner end of the upper level 62, and the upper surface of the lower level 63 substantially abuts the lower end of the lug 9. When the outer part 65 of the release member 60 is pressed down, the entire release member 60 including a leg 67 loosely fitted in a hole 66 in the receptacle 1 swings about a corner 68 serving as a fulcrum, thereby causing the lower level 63 to thrust up the lug 9. As the result, a second latch tongue 10 disengages from the first latch tongue 12 to release the cover 3 (See FIG. 12). This arrangement has an advantage that the upward thrust from the release member 60 can be more directly utilized for disengagement. The other structures are substantially the same as those of the first embodiment, except that the indentation 11 extends through the receptacle 1 to accommodate the lower level 63 therein.

Figure 13:
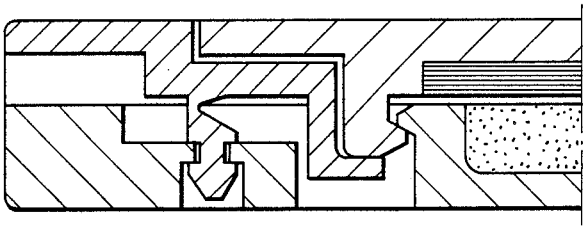
FIG. 13 is a fragmentary sectional view showing a modified example thereof.
Figure 14:
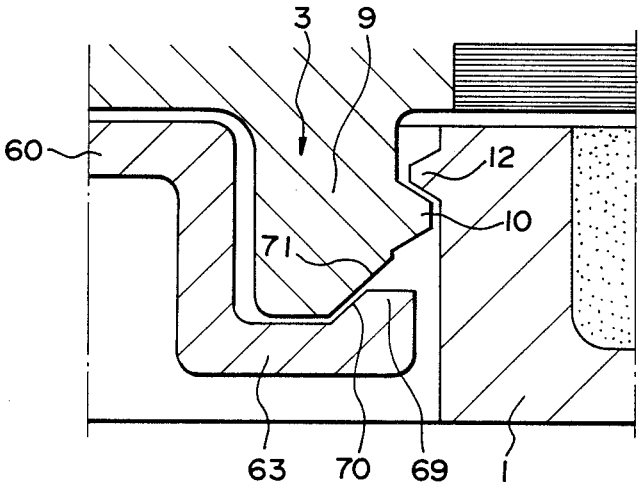
FIG. 14 is an enlarged fragmentary sectional view of another modified example.

Although in the above fifth embodiment the swing motion is effected by loose fit of the leg 67 in the hole 66, it can also be performed by providing a hinge portion at the upper end of the leg as in the second embodiment (See FIG. 13), or by the combination of the loose fit and the hinge portion as in the fourth embodiment. Further, in a modified example of FIG. 14, a hook 69 is provided at the end of the lower level 63 such that an inclined or slant surface 70 of hook 69 is disposed opposite a slant surface 71 at the lower end of the lug 9. When the release member 60 is operated, the hook 69 thrusts the lug 9 forwardly, namely, in a direction away from the rear wall of the indentation 11 to ensure a smooth disengagement of the second latch tongue 10 from the first latch tongue 12.

Figure 15A:
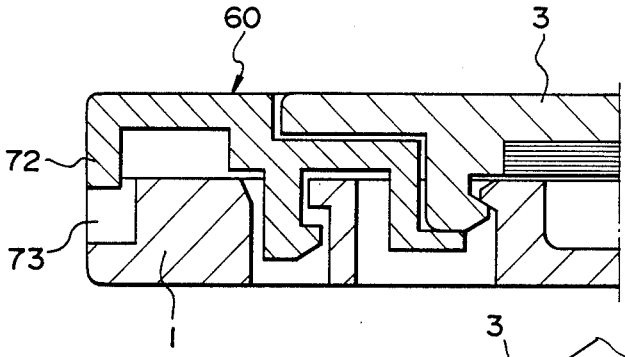
FIGS. 15A and 15B are respectively a fragmentary sectional view and a fragmentary perspective view of still another modified example.
Figure 15B:
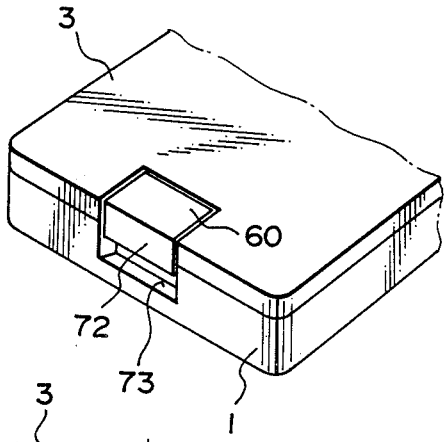
Figure 16:
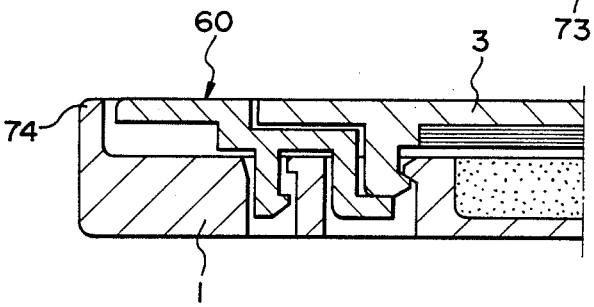
FIGS. 16A and 16B are views similar to FIGS. 15A and 15B, respectively, showing a further modified example.
Figure 16:
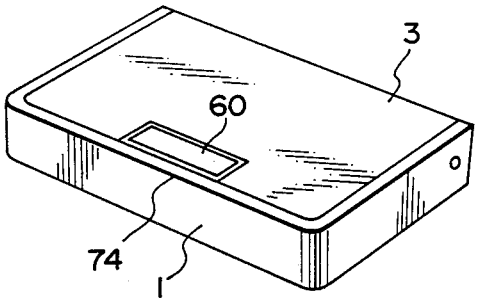

In order to enhance visual appeal of the vanity case a vertical extension 72 may be provided which extends downwardly from the front end of the release member 60 to conceal a gap between it and the receptacle 1, as shown in FIGS. 15(A) and 15(B). A cutout 73 may be formed at the front end of the receptacle 1 to permit the extension 72 to enter therein when the release member 60 swings. Alternatively, a vertical flange 74 may be formed along the periphery of the receptacle 1 with the release member 60 disposed inside this flange 74 as shown in FIGS. 16(A) and 16(A). Although the release members as shown in FIGS. 15(A)–16(B) are of the two-step type, needless to say, such features can be used in any of the release members described above.

Figure 17:
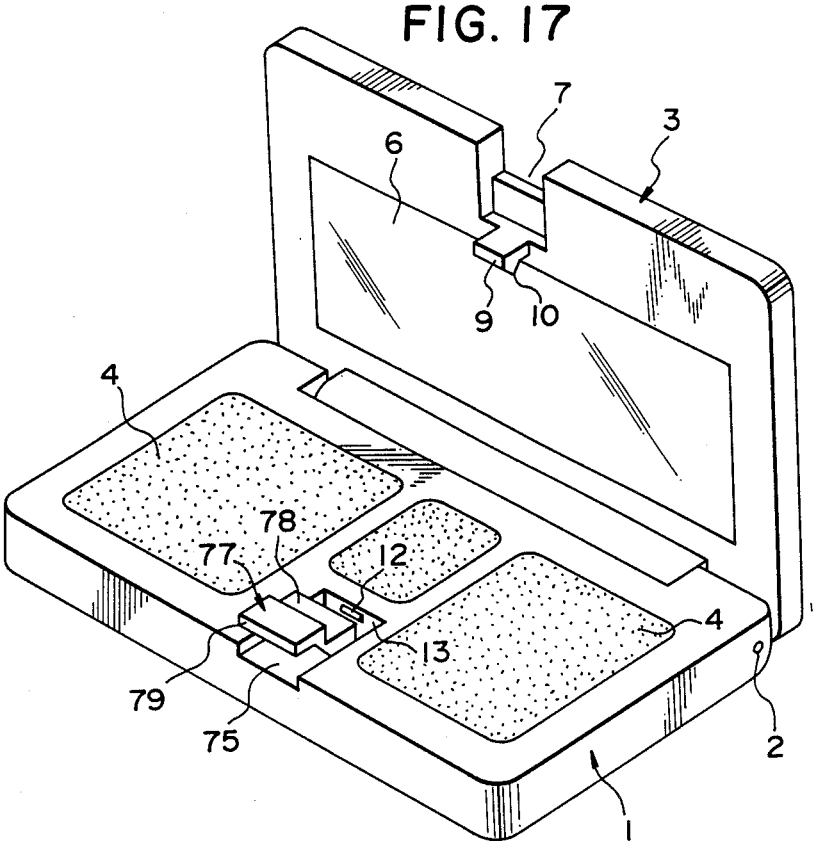
FIG. 17 is a perspective view of a vanity case according to a sixth embodiment of the invention.
Figure 18:
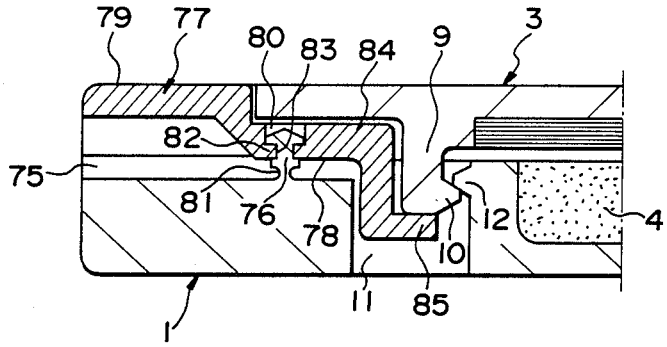
FIG. 18 is a fragmentary sectional view of the vanity case of FIG. 17.
Figure 19:
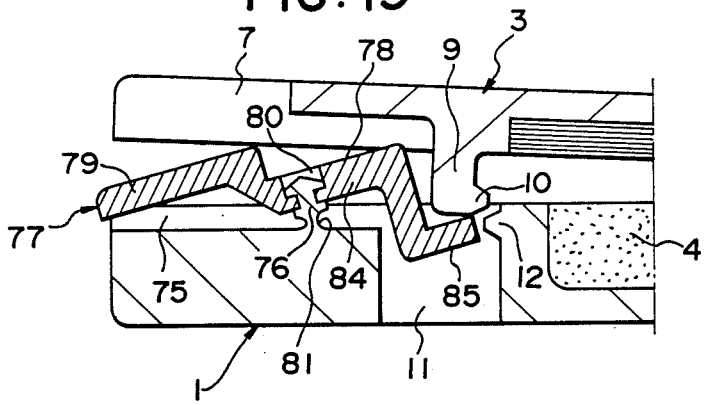
FIG. 19 is a view similar to FIG. 18 showing a releasing operation.

FIGS. 17 to 19 show a vanity case according to a sixth embodiment of the present invention which is different from the above embodiments in that the arrangement of the leg and hole is contrary to that of the above embodiments. That is, in the upper surface of the receptacle 1 in front of the indentation 11 is provided a groove 75 having a width substantially equal to the width of a release member 77, and a leg 76 extends upwardly from the bottom of the groove 75 to be fitted in a hole 80 which is formed through an inner part 78 of release member 77. The base section of the leg 76 is cut away at both sides thereof to form a thin flexible hinge portion 81 which permits the leg 76 to swing relative to the receptacle 1. Provided at the entrance of the hole 80 is a flange 82 which is tightly fitted in a coupler groove 83 formed on the leg 76 such that the release member 77 is fixedly fastened to the leg 76. The inner part 78 of the release member 77 is formed in two levels of which upper level 84 is provided with the hole 80 while a lower level 85 abuts the lower end of the lug 9 of the cover 3. When the outer part 79 of the release member 77 is pressed down, the applied force is transmitted to the leg 76 via the hole 80 and therefore the leg 76 swings at the hinge portion 81, allowing the entire release member 77 to swing relative to the receptacle 1. Consequently, the lower level 85 of the inner part 78 thrusts up the lug 9 to thereby disengage the second latch tongue 10 from the first latch tongue 12 and to open the cover 3 (See FIG. 19).

Figure 20:
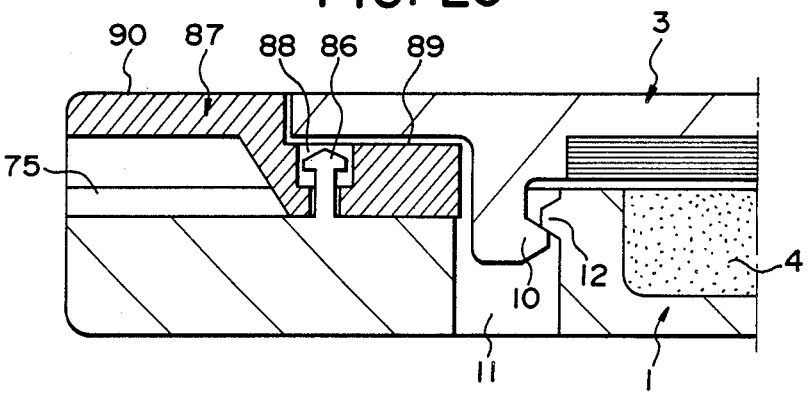
FIG. 20 is a fragmentary sectional view showing a modified example of the sixth embodiment.
Figure 21:
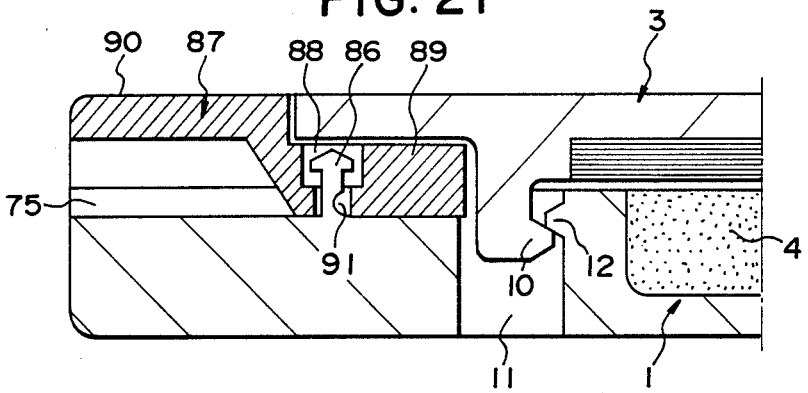
FIG. 21 is a fragmentary sectional view of another modified example thereof.

Needless to say, this arrangement in which the leg is provided on the receptacle 1 and the hole is provided in the release member can be employed in the above-described various types of vanity cases. FIGS. 20 and 21 show examples of such applications. In a vanity case of FIG. 20, a leg 86 of the receptacle 1 is loosely fitted in a hole 88 formed in a release member 87 whereby the release member 87 can swing relative to the leg 86 and the receptacle 1, which permits an inner part 89 to thrust up the cover 3 when an outer part 90 of the release member 87 is pressed down. Also, a vanity case of FIG. 21 has a flexible hinge portion 91 formed at the base of the leg 86 described above so that, when an outer portion 90 is pressed down, the release member 87 can swing relative to the leg 86 which in turn can swing at the hinge portion 91.

As will be understood from the foregoing description, in the vanity case according to the invention a cover can be opened simply by pressing downwardly an outer part of release member with a slight force due to a leverage action. The arrangement of release the member between the receptacle and the cover makes it possible to increase a stroke of movement of the release member without increasing the thickness of the receptacle member, resulting in achieving good operability as well as a small thickness of the receptacle member. Further, as the release member is secured to the receptacle by means of a leg, the requirement of dimensional accuracy can be relaxed when compared with a pivotal attachment of the prior art. This not only will reduce the number of inferior products due to dimensional errors, but also will make it possible to simplify required molding dies, with a resultant reduced manufacturing cost.

Although the present invention has been described with reference to the preferred embodiments thereof, many modifications and alterations may be made within the spirit of the invention.

What is claimed is:

1. A vanity case comprising:

a receptacle member;

a cover member hinged to said receptacle member at a rear end thereof, said cover member having a front marginal portion with a cutout formed therein:

a first latch tongue formed on said receptacle member;

a second latch tongue formed on said cover member;

said first and second latch tongues engaging each other to maintain said cover member in a closed position with respect to said receptacle member;

a release member disposed between a periphery of said receptacle member and a periphery of said cover member, said release member including a generally planar inner part and a generally planar outer part extending parallel to said inner part and positioned at a level higher than said inner part and connected by a step with said inner part, wherein when said cover member is in said closed position said inner part is directly below a lower surface of said cover member and said outer part is located in said cutout with an upper surface of said outer part being substantially flush with an upper surface of said cover member and with a lower surface of said outer part spaced from an upper surface of said receptacle member;

a hole formed in one of said release member and said receptacle member; and a leg formed on the other of said release member and said receptacle member, said leg being fitted in said hole to thereby attach said release member to said upper surface of said receptacle member is such a manner that said release member is swingable relative to said receptacle member.

2. A vanity case as claimed in claim 1, wherein said leg is loosely fitted in said hole whereby said release member is swingable relative to said receptacle member.

3. A vanity case as claimed in claim 2, wherein said leg has formed at an end thereof an enlarged head, and wherein said hole has a size at an entrance thereof smaller than the size of said enlarged head to secure said leg in said hole.

4. A vanity case as claimed in claim 3, wherein a wall defining said entrance of said hole has a slant surface for permitting said leg to swing.

5. A vanity case as claimed in claim 2, wherein said leg projects from an underside of said release member and said hole is formed in said upper surface of said receptacle member.

6. A vanity case as claimed in claim 5 wherein said leg has formed at a base end thereof a thin flexible hinge portion for permitting said release member to swing relative to said leg.

7. A vanity case as claimed in claim 2, wherein said leg projects from said upper surface of said receptacle member and said hole is formed in said release member.

8. A vanity case as claimed in claim 7, wherein said leg has formed at a base end thereof a thin flexible hinge portion for permitting said leg to swing relative to said receptacle member.

9. A vanity case as claimed in claim 1, wherein said leg is fixedly fitted in said hole and has formed at a base end thereof a thin flexible hinge portion for permitting said release member to swing relative to said receptacle member.

10. A vanity case as claimed in claim 9, wherein said leg projects from an underside of said release a member and said hole is formed in said upper surface of said receptacle member, and wherein said hinge portion permits said release member to swing relative to said leg.

11. A vanity case as claimed in claim 9, wherein said leg projects from said upper surface of said receptacle member and said hole is formed in said release member, and wherein said hinge portion permits said leg to swing relative to said receptacle member.

12. A vanity case as claimed in claim 1, wherein said cover member has formed on said lower surface thereof a lug and said receptacle member has formed in said upper surface thereof an indentation for receiving said lug, and wherein said first latch tongue is formed on a rear wall defining said indentation and said second latch tongue is formed at a lower end of said lug.

13. A vanity case as claimed in claim 12, wherein said inner part of said release member comprises an upper level and a lower level, said lower level being positioned adjacent said lower end of said lug when said cover member is in said closed position.

14. A vanity case as claimed in claim 1 wherein a recess is formed in said lower surface of said cover member inside said cutout and wherein said inner part of said release member is positioned in said recess when said cover member is in said closed position.

* * * * *